US005857939A

United States Patent [19]

Kaufman

[11] Patent Number: 5,857,939

[45] Date of Patent: Jan. 12, 1999

[54] EXERCISE DEVICE WITH AUDIBLE ELECTRONIC MONITOR

[75] Inventor: Arthur H. Kaufman, Boca Raton, Fla.

[73] Assignee: Talking Counter, Inc., Boca Raton, Fla.

[21] Appl. No.: 869,749

[22] Filed: Jun. 5, 1997

[51] Int. Cl.[6] ..... A63B 69/00

[52] U.S. Cl. ..... 482/8; 482/1; 482/9; 482/902; 601/23; 73/379.01

[58] Field of Search ..... 482/1–9, 900–902; 601/23, 33–36; 73/379.01–379.09

[56] References Cited

U.S. PATENT DOCUMENTS

| | | | |
|---|---|---|---|
| 4,605,224 | 8/1986 | Torii . | |
| 4,702,475 | 10/1987 | Elstein et al. . | |
| 4,824,103 | 4/1989 | Smidt | 482/902 |
| 4,831,242 | 5/1989 | Englehardt et al. . | |
| 4,834,375 | 5/1989 | Elstein et al. . | |
| 4,883,067 | 11/1989 | Knispel et al. . | |
| 4,932,879 | 6/1990 | Ingenito et al. . | |
| 4,969,194 | 11/1990 | Ezawa et al. . | |
| 4,979,735 | 12/1990 | Stewart . | |
| 5,124,960 | 6/1992 | Miller et al. . | |
| 5,538,486 | 7/1996 | France et al. | 482/1 |

*Primary Examiner*—Glenn Richman
*Attorney, Agent, or Firm*—Adams & Wilks

[57] ABSTRACT

An electronic exercise monitor for monitoring the repetitive performance of an exercise comprises a switch having a contact member connected to a displaceable member of the exercise equipment, the switch being responsive to the reciprocal motion of a displaceable member of an exercise device to output a signal for each of a plurality of sequential exercise repetitions performed by the user on the exercise equipment, a processor for receiving the signals and determining for each a starting address at which a block of corresponding sound data is stored, a memory for storing sound data for each of the plurality of sequential exercise repetitions, the sound data preferably comprising data representing a voice count number for each repetition of an exercise, and a speech generator for generating a naturally-sounding human voice or reproducing a digitized version of an actual human voice or other audible indicia in accordance with the sound data stored in the memory. The speech generator is controlled by the processing means in response to the switch to progressively count sequential exercise repetitions performed by the user. In addition to providing a verbal count of successively performed exercise repetitions, motivational speech may also be generated to encourage correct and continued performance of the exercise.

12 Claims, 7 Drawing Sheets

EXERCISE DEVICE WITH AUDIBLE ELECTRONIC MONITOR

FIELD OF THE INVENTION

The present invention relates generally to an exercise monitoring device and, more particularly, to an audible exercise monitoring device and repetition counter designed for stand-alone use, to be worn on a part of a user's body, for incorporation into an exercise mat, or as part of a piece of exercise equipment of the type having a displaceable member adapted to undergo reciprocal movement in response to a repetitive curling or pressing force of a user. More specifically, the present invention relates to an audible electronic exercise monitoring, coaching and training device which monitors the user's exercise performance and issues audible indicia, such as a verbal count of the number of exercise repetitions performed by the user and/or audible alarms, verbal instructions and verbal motivation and encouragement.

DESCRIPTION OF RELATED ART

A wide variety of different types of equipment is available for exercising different individual muscles and muscle groups of the human body. Free weights, such as dumbbells and barbells, have long been widely used in both commercial and residential settings. Low cost universal-type weight training equipment has more recently become accessible to consumers for residential use, as have sophisticated cardiovascular exercise devices such as electromechanical stationary bicycles, motorized treadmills, hydraulic stair climbers, rowing machines, aerobic riders, aerobic flyers, and the like.

Many different types of cardiovascular exercise equipment are provided with electronic monitoring devices for tracking the user's performance and providing the user with a practical performance target or goal. Even inexpensive stationary bicycles, stair climbers and treadmills are often provided with built-in timers, pulsemeters, calorie counters, speedometers, odometers and/or pedometers. Such devices are relatively inexpensive to produce and are simple in design, relying upon the use of a single programmed microprocessor or application-specific integrated circuit to calculate various information using performance data acquired from standard sensors. For instance, the number of calories expended during an exercise may be determined using a simple calculation based upon the exercise resistance, exercise rate and elapsed time. Pulse rate monitoring devices are also of simple design and low cost. By monitoring the user's pulse, the number of calories expended and the like, the user may be provided with a practical indication of his or her exercise progress and performance.

The use of electronic monitoring instruments in conventional cardiovascular training equipment has had some beneficial fitness results, including a moderate increase in the level of user interest and an increased level of exercise performance. However, the most beneficial results of any exercise are obtained when an individual is given a specific, easily understandable performance target, is informed of his or her exercise progress, and is given verbal motivation, coaching, encouragement and instruction. When this is done, the individual is generally more interested in performing an exercise routine correctly and completely, and the results of the exercise routine are markedly improved.

While pulsemeters, calorie counters, odometers, pedometers, and the like, serve to increase user interest, they do not serve to motivate or coach the individual to complete an exercise program. Nor do such devices ensure that an individual is performing an exercise routine correctly or completely. Moreover, electronic monitoring devices of the type described above are of limited utility in non-cardiovascular, strength training exercise equipment such as free weights and isometric exercisers. While such devices are useful for monitoring cardiovascular exercises, information such as pulse rate, elapsed time and calories expended is, at best, of secondary importance in non-cardiovascular exercises, which are generally designed to increase muscle strength. While the primary goal of cardiovascular exercise is to maintain a target elevated pulse rate for a prolonged period of time, most non-cardiovascular exercises are directed at targeting individual muscles for a relatively short period of time to increase strength. Such exercises do not result in prolonged heart rate elevation. Thus, even highly sophisticated non-cardiovascular training equipment is not generally provided with electronic monitoring equipment similar to that described above. Users of such equipment are therefore required to perform non-cardiovascular exercises in the presence of fitness professionals or are otherwise relegated to perform boring, strenuous exercise routines alone.

Although they are perhaps the most important part of any weight training exercise routine, the last one or two repetitions are also the most difficult to perform. At the point an individual reaches the last few repetitions of an exercise, the individual is under a great deal of physical stress. Despite the importance of the last few repetitions of such an exercise, these last repetitions are extremely difficult. In the absence of a spotter or personal trainer for providing verbal motivation and encouragement, many individuals have found it difficult to properly complete these last few repetitions of a weight training exercise due to the lack of self-motivation brought on by intense physical stress. Although prior art monitoring devices exist for monitoring the results of an exercise, no previously-available electronic exercise monitoring device has addressed the need for providing an individual with the motivation and encouragement needed to complete an exercise routine.

Another good example of this is situps and pushups. While pushups are a highly beneficial exercise, there are no electronic monitoring or coaching devices available for use in conjunction with pushups. Similarly, situps are generally the most straightforward and useful exercise motion for addressing the entire abdominal structure of the human body. However, they are also strenuous to perform, boring and very difficult to monitor. There are no electronic monitoring devices available for stand-alone use in conjunction with situp or pushup type exercises, and the individual performing such exercises must either rely upon another person to monitor their performance or must somehow keep track of his or her own performance.

Even though several types of exercise devices have been developed for use in exercising the abdominal muscles by augmenting the natural resistive force of gravity against the human body, such devices are not generally provided with any type of electronic monitoring equipment similar to that provided in cardiovascular fitness equipment.

Although there are a virtually unlimited number of different types of mechanical devices designed to replace exercises such as pushups and situps, most of these devices, despite their high cost, provide little or no added benefit over fundamental exercises such as situps and pushups. Nor do any of these devices provide a means for monitoring, motivating, or coaching the user to correctly and completely perform an exercise.

For instance, various types of rotary movement abdominal exercise devices are available that target the abdominal muscles. Some such devices are designed to facilitate curling motion while a person is originally lying in a supine position. Other such devices are designed to facilitate such motion while a person is in a seated position. Such equipment, however, is entirely mechanical in nature and is not generally provided with electronic monitoring devices. In one known abdominal exercise device, for example, the user performs abdominal curling exercises against a resistance provided by the machine. The user is seated in an upright position and performs the curling and uncurling motion against a resistance provided by a bar mounted in a cantilevered manner on an arm which pivots about a fixed point forwardly and rearwardly with the user's curling and uncurling exercise motion. In another well known variation of this device, the bar is adapted to undergo variable resistance throughout the curling and uncurling motion to maximize exercise benefits. There are no electronic monitoring devices provided in this type of equipment for monitoring a user's performance and offering verbal motivation and encouragement. As a result, the individual is required to monitor his or her own performance or to rely upon another person, such as a personal trainer.

Another abdominal exerciser which, very recently, has become popular is designed to support the user's head and neck while performing situp type exercises from a supine position. The device is formed of a tubular frame defining a pair of laterally spaced support rails, a pair of laterally spaced rocker portions, a pair of laterally spaced arm rest portions and a connecting portion for connecting the support rails together. Cushions are disposed on the arm rest portions to receive the elbows of the user when in a lying position. The head and neck of the user are supported on a padded support extending across the connecting portion. In one variation of this device, the rocker portions are curved on a circular arc to match the curvature of the spine when performing the situp type exercises. In another variation of this device, the rocker portions are merely pivot points designed to facilitate rocking motion on a circular arc, also to match the curvature of the spine when performing the situp type exercises. While this basic device is available in various other configurations, with or without arcuate portions, each such variation is designed to support the user's neck and head when performing situps or crunches. For example, in another variation, the connecting portion is disposed proximate the arm rest portions of the device, rather than the head rest portion.

Much like weight training equipment and other types of non-cardiovascular fitness equipment, none of the foregoing types of exercise equipment is provided with an electronic device for monitoring the user's performance level, increasing the user's interest level by providing verbal motivation and encouragement, or informing the user of an attainable goal. Additionally, there are very few available monitoring devices for use with exercises that are performed without the use of any type of exercise device. Situps, for example, may be performed on an exercise mat or floor without the use of a curling device. Pushups may also be performed on any flat surface. When an exercise is performed without the use of any type of exercise equipment, no electronic monitoring device is generally used. A need therefore exists for an electronic exercise monitor for stand-alone use, to be worn on a part of the user's body, or for incorporation into a piece of exercise equipment to provide the user with information concerning his or her performance and to provide the user with verbal encouragement and motivation to perform an exercise correctly and completely.

Although there have been previous attempts to provide such encouragement through the use of pre-recorded audio and video exercise programs, no such program is capable of monitoring the performance of the user while performing the exercise described and shown on the pre-recorded program.

SUMMARY OF THE INVENTION

In view of the foregoing, an object of the present invention is to provide a device for use in monitoring the progress and performance of an exercise routine and for ensuring that the exercise routine is correctly performed.

Another object of the present invention to provide a stand-alone exercise monitoring device for monitoring isometric exercises performed by a user without using a piece of exercise equipment.

Still another object of the present invention is to provide a device designed to coact with various different types of exercise equipment to verbally count the number of repetitions being performed by a user.

Yet another object of the present invention is to provide a device capable of monitoring the number of exercise repetitions performed using a known exercise device.

Still yet another object of the present invention is to provide an exercise monitor capable of detecting when exercises are being performed improperly by the user and issuing an audible alarm.

An additional object of the present invention is to provide an electronic exercise monitor which verbally informs the user of his or her exercise progress and/or which offers the user verbal encouragement and motivation.

These and other objects are achieved by the present invention, which provides an electronic exercise monitoring device for monitoring the repetitive performance of an exercise. The exercise monitoring device comprises exercise movement detection means for detecting an exercise repetition and outputting a repetition signal, processing means for receiving the repetition signal and determining a start address at which a corresponding block of sound data is stored for each of a plurality of repetition signals indicative of successive exercise repetitions, a memory for storing the sound data, and a speech synthesizer for synthesizing a human voice in accordance with the sound data.

In accordance with one aspect of the present invention, the electronic exercise monitor is adapted for stand-alone use to permit use of the device in conjunction with exercises that are performed without the use of a piece of exercise equipment. The exercise monitor utilizes an exercise motion detector, such as an accelerometer, for detecting the repetitive motion associated with the performance of successive exercise repetitions and for outputting a corresponding repetition signal. In accordance with this aspect of the present invention, the exercise monitor is preferably provided in a case or package that may be worn on a user's wrist, ankle, waist, glove, neck, hat, and the like. Alternatively, the exercise monitor may be encased in a piece of exercise equipment or an exercise mat, in which case the motion detector preferably comprises a switch capable of detecting successive repetitions of a repetitive exercise, such as presses, extensions, pushups or situps, that are being performed.

In accordance with another aspect of the present invention, the exercise monitor is incorporated at least partially into a piece of exercise equipment and comprises a switch having means for detecting movement of a displaceable member of the exercise equipment, such as a cantilevered arm, a cable, a barbell, or the like, the switch being responsive to the reciprocal motion of the displaceable member, for example, to output a repetition signal for each of a plurality of sequential exercise repetitions performed by the user on the exercise equipment.

In each of the above-described aspects of the present invention, the processing means receives the repetition signals and determines for each repetition signal a starting address at which a block of corresponding sound data is stored. The memory stores sound data for each of the plurality of sequential exercise repetitions. The sound data preferably comprises data representing a voice count number for all, most or some repetitions of an exercise. In order to enunciate a voice count, the exercise monitor is further provided with a speech generator for generating a naturally-sounding human voice or reproducing a digitized version of an actual human voice or other audible indicia in accordance with the sound data stored in the memory. The speech generator is controlled by the processing means in response to the switch to progressively count sequential exercise repetitions performed by the user.

Preferably, the switch has a contact member disposed such that each full cycle of motion of the displaceable member causes a single, temporary closure of the switch contacts so as to permit the generation of a single pulse and to permit detection of successive exercise repetitions which are to be verbally counted by the exercise monitor. A voice count is generated for all or only for selected ones of the exercise repetitions. In accordance with the present invention, the electronic exercise monitor provides a verbal repetition count value rather than merely a visual count value, such that the user need not be mindful of a visual display. However, a visual display may also be provided to supplement the verbal count and to indicate the number of repetitions in cases where a verbal count is not issued for each individual repetition.

In order to enable the user to set a desired exercise rate, a desired number of repetitions per set, and a desired enunciation pattern, the electronic exercise monitor is preferably provided with a first selector for selecting an exercise rate at which human voice patterns will be produced, the selected rate being variable between a predetermined minimum value and a predetermined maximum value (i.e., a tempo), a second selector for selecting a desired number of repetitions per set (hereinafter referred to as a "repetition number"), and a third selector for selecting an enunciation pattern at which the human voice will be produced, such as by issuing a verbal count every one repetition, or issuing a verbal count every five repetitions, or issuing a verbal count every ten repetitions, etc. When the first through third selectors are included, the processing means is provided with means responsive to the first through third selectors for setting the rate at which the human voice is read out from the memory, for detecting when to reset the count value so as to count successive sets of an exercise, and for controlling the enunciation pattern in the desired manner.

In addition to monitoring the number of repetitions of an exercise, the exercise monitor may also be programmed to issue verbal encouragement to the user, so as to motivate the user to continue to perform the exercise correctly. In order to accomplish this, the processing means may be programmed to issue verbal encouragement between or in the place of one or more successive verbal count numbers and/or sets. Thus, for example, where the verbal encouragement comprises only one or two short words, it may be issued between successive repetition counts. Depending upon the available time between successive counts, however, where the verbal encouragement comprises a longer phrase, it may be generated to replace one or more verbal repetition counts, while the processing means keeps track of the proper count. When the exercise rate is relatively slow, or between sets, however, even a long phrase may be inserted between successive repetition counts. As will be appreciated by those of ordinary skill in the art, the processing means is programmed to determine the appropriate insertion point for verbal phrases of any given duration.

In one embodiment of the present invention, the switch of the exercise monitor is mounted to a displaceable member of an abdominal exercise device which is constructed of a tubular frame comprising a pair of laterally spaced support rails for resting on a support surface (i.e., a floor), a pair of laterally spaced rocker portions each of which extends forwardly from a respective support rail and a pair of laterally spaced arm rest portions, each of which extends rearwardly from a respective rocker portion to receive an elbow and arm of a person disposed between the support rails in a supine position. The switch is mounted to a portion of the tubular frame which comes into and out of contact with the support surface (the floor) once each exercise repetition. An upstanding arch-shaped portion is connected to and between the support rails to define a space to receive the head of a person disposed between the support rails. A support means is also secured to and across the arch-shaped portion of the skeletal frame for supporting the neck and head of a person disposed between the support rails. During an exercise program, the user repeatedly curls his or her upper body in a forward and rearward rocking motion, which allows the user to strengthen the abdominal muscles.

When in use, the person rests his or her elbows or arms on the arm rest portions while lying down and then repeatedly curls his or her body forwardly and rearwardly while rocking on the rocker portions. The switch of the exercise monitor is mounted to the tubular frame in such a manner that closure of the switch contact members occurs once for each exercise repetition, when the portion of the tubular frame on which the switch is mounted comes into contact with the support surface. When the switch contact members come into contact, a current flows through the switch and is detected by the processing means. When the portion of the tubular frame on which the switch is mounted comes out of contact with the support surface, the switch contact members are opened, and no current flows through the switch. By monitoring the flow of current through the switch, the processing means is capable of monitoring the exercise progress of the user. The user conducts isometric contractions by applying a force through his or her arms to the exercise device which, in turn, causes lifting of the head, neck and upper body of the person when contracting the abdominal muscles. The exercise monitor provides a verbal count of the repeated cyclical forward and rearward curling motions and optionally issues synchronized verbal encouragement to the user in the manner described above and set forth in greater detail hereinafter in connection with the detailed description of the attached drawings.

DETAILED DESCRIPTION OF THE PREFERRED EMBODIMENTS

Figure 1:
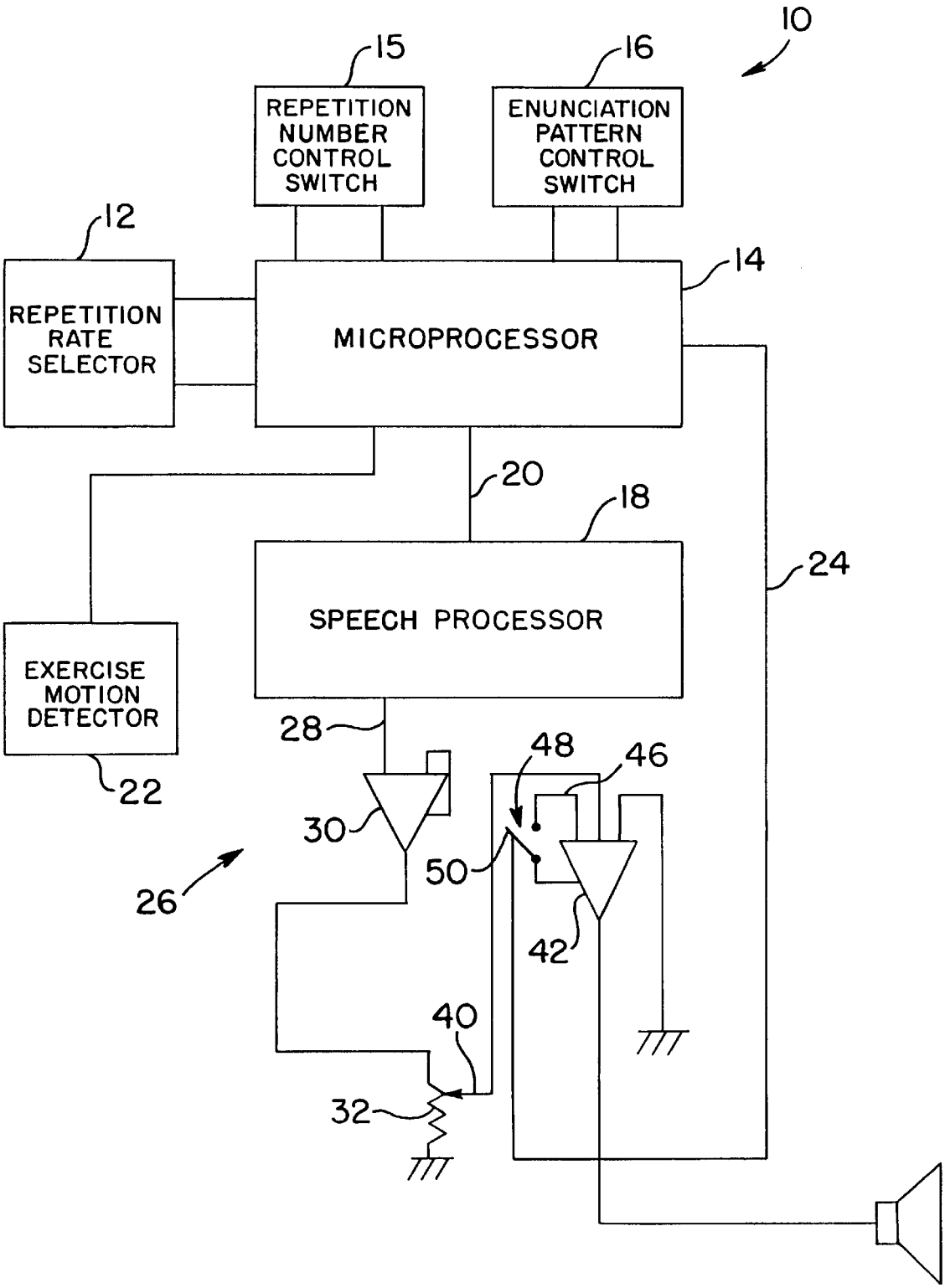
FIG. 1 is a schematic diagram of an electronic exercise monitoring apparatus in accordance with a first embodiment of the present invention.

FIG. 1 is a schematic diagram of an exercise monitoring apparatus 10 in accordance with a first embodiment of the present invention, in which the device is configured as an exercise repetition counter/monitor. The system has four main control functions, exercise rate, number of repetitions per set, enunciation pattern, and volume, which produce a synthesized speech pattern that is effective to provide the user with a continuous count of his or her exercise repetitions, to assist the user in maintaining a desired exercise rate, and to ensure that the user is correctly performing the exercise. The selection of the desired exercise rate, in repetitions per minute, is made by setting a repetition rate selector 12. The repetition rate selector 12 preferably comprises a multi-position switch having poles selectively tied, for example, to +5V so as to provide an input level compatible with that of a processing means, such as a microprocessor 14 or a microcontroller. Alternatively, the repetition rate selector 12 may be in the form of a potentiometer control and designed to produce a pulse train at a frequency corresponding to the desired repetition rate. In the latter case, the repetition rate selector 12 would preferably comprise a monostable multivibrator and a potentiometer control for varying the RC time constant of the monostable multivibrator to produce pulses of a time duration which is a function of the RC time constant at a frequency corresponding to the desired repetition rate.

The range of exercise rates provided by a multi-position switch, or the range of frequency of pulses produced by the repetition rate selector 12 is variable between minimum and maximum rates which are set as realistic rates depending upon the particular exercise. Thus, for example, when the exercise is situps, the device would be set to provide a minimum repetition rate of, for example, 20 repetitions per minute and a maximum repetition rate of 200 repetitions per minute. On the other hand, when the exercise is one such as bench presses, a maximum repetition rate of 100 repetitions per minute and a minimum repetition of 5 repetitions per minute may be more realistic. The output signal of the repetition rate selector 12 is input to the programmed microprocessor 14. The function of the repetition rate selector 12 in the operation of the microprocessor 14 is described below in conjunction with the flowchart illustrated in FIG. 2.

The desired number of repetitions per set (hereinafter referred to as the "repetition number") and the desired enunciation pattern are selected by setting a repetition number control switch 15 and an enunciation pattern control switch 16, each of which may be a multi-position switch with each pole position corresponding to a desired repetition number and enunciation pattern, respectively. In the preferred embodiment of the invention presently being described, there are four distinct repetition numbers and four distinct enunciation patterns which may be chosen by positioning of repetition number control switch 15 and enunciation pattern control switch 16. As described in greater detail below, the selected repetition rate, repetition number and enunciation pattern are used by the programmed microprocessor 14 to determine the location of a particular address table stored in the microprocessor memory for addressing particular voice data in a speech synthesizer or speech processor 18. A plurality of separate sets of voice data are stored in the memory of the speech synthesizer 18 and the particular set of voice data chosen for synthesis is determined in accordance with the values of the repetition rate, the repetition number and the enunciation pattern. Thus, the actual human voice pattern which is enunciated for each repetition is set in accordance with the repetition rate, repetition number and enunciation pattern.

The reason a plurality of different sets of voice data address tables are preferably used is to enable the device to generate a natural sounding voice which varies depending upon the rate at which the exercise repetitions must be counted. The particular address table selected also depends upon the enunciation pattern since the particular address locations of the table determine which repetitions will be verbally counted, which repetitions will not be verbally counted, which repetitions will be indicated by non-verbal audible indicia such as by a beep, and which count values or other words will be emphasized. The particular address table that is selected also depends upon the repetition number since the particular address locations also determine how high the count will proceed until the address is reset (i.e., when the end of a set is reached). In addition, if the enunciation pattern control switch 16 is set such that a verbal count is not generated for each successive repetition, the enunciation of each count can be slower than if a verbal count is required for each successive exercise repetition.

For instance, where only 20 repetitions per minute are to be performed, one verbal count is generated every three seconds, depending upon the selected enunciation pattern. Where 100 repetitions per minute are to be performed, a separate verbal count may be required in intervals of less than one second depending, again, upon the selected enunciation pattern. However, where the enunciation pattern control switch 16 is set to issue a verbal count only for each five or ten repetitions, for example, a greater amount of time is permitted for each verbal count. Thus, depending upon the selected repetition rate, repetition number and enunciation pattern, different address tables are needed to ensure the generation of a naturally-sounding human voice.

As used herein, the enunciation pattern refers to the desired voice pattern of the repetition counter. For instance, the user may desire for the device to issue a verbal count for each individual exercise repetition performed by the user. In cases where there are a large number of repetitions per set, for instance, the user may prefer that the verbal count is spaced out such as by being generated only for each five or ten repetitions, or only upon the completion of each complete set. In addition, the user may prefer that an audible sound other than a human voice (i.e., a beep) is generated for each one or more exercise repetitions. The combination of a human voice and other audible sound is also possible, such as by generating a human voice for every five or ten repetitions and generating a beep or other non-verbal sounds for each repetition therebetween.

As will be appreciated by those of ordinary skill in the art, there are a virtually unlimited number of possible enunciation patterns which may be made available. The preferred enunciation patterns discussed above are illustrative only and many different patterns may be used. For example, the enunciation pattern control switch 16 may be provided with settings indicating selectable enunciation patterns of "1", "½", "¼", or "SET". In this case, the setting "1" means that a verbal count is generated for each exercise repetition. The setting "½" means that a verbal count is generated only halfway through each set. Similarly, the setting "¼" means that a verbal count is generated at each of the four quarters of a given exercise set. When the enunciation pattern control switch 16 is placed in the "SET" position, a verbal count is generated only when each successive set of exercise repetitions is completed by the user.

As will be appreciated by those of ordinary skill in the art, the use of a different address table for each combination of repetition rate, repetition number and enunciation pattern is exemplary, and a different address table may not actually be needed for each different combination in order to ensure the generation of a naturally sounding human voice. For example, the address tables can instead be dependent only upon the different combination of repetition number and enunciation pattern. This would be preferable when a potentiometer control and a monostable multivibrator are used as the repetition rate selector. As discussed later, in that case, the time base of the verbal count numbers can be changed depending upon the frequency of pulses output by the multivibrator. On the other hand, the microprocessor 14 can be programmed to monitor for the end of a set and the address tables can be selected based solely upon the enunciation pattern set by the user. This method of operation would be utilized, for example, when the exercise monitor does not include a selector for the setting of one or more of the repetition rate, repetition number and enunciation pattern. Even when one or more of the selectors is provided, the address tables can be eliminated entirely by appropriate programming of the microprocessor 14 to detect, on a step-by-step basis whether a verbal count number or other audible indicia must be generated for a repetition, in accordance with the set enunciation pattern, and by similarly determining whether the end of a set has been reached. The microprocessor program may also include instructions to determine when a verbal count number is to be generated based upon the number of repetitions per set selected by the repetition number control switch 15. These and other similar variations are considered to be within the scope of the present invention.

The microprocessor or microcontroller 14 preferably has an internal memory ("EEPROM") that is used to store an internal program and program data including the above-described plurality of address tables for identifying the addresses of the sequence of words stored within the dictionary of words of the speech synthesizer 18 which are to be used to synthesize the human voice pattern for each of the possible combinations of repetition rate, repetition number and enunciation pattern selected by the repetition rate selector 12, repetition number control switch 15 and enunciation pattern control switch 16. The information content which is stored in the table in the EEPROM is described below. The speech synthesizer 18 may be a group of integrated circuits which are commercially available and which have either a standard dictionary of words or a special purpose dictionary of words, and may also be a specially ordered or application-specific integrated circuit designed to synthesize speech patterns from a specially programmed dictionary. Alternatively, the speech synthesizer may be a single chip device such as one of the ISD2500 Series single-chip voice record/playback devices produced by Information Storage Devices, Inc. These commercially available single chip voice record/playback devices include an on-board memory for storage of speech samples, and have 60 sec., 75 sec. and 90 sec. durations. The speech samples are stored in the chip using programming equipment made available by the manufacturer. As will be clear to those of ordinary skill in the art, the speech synthesizer 18 utilized in the invention may also be of the type that is provided with an internal microcontroller in a single chip construction, such chips being available from Texas Instruments, for example.

In the FIG. 1 embodiment, the programmed microprocessor 14 controls the synthesis of each word from the speech synthesizer 18 by producing an output on an address bus line 20 of the location of the word in the dictionary of the speech synthesizer 18.

An exercise motion detector 22, such as a mechanical switch, provides an output signal which is input to the microprocessor 14. In order for the exercise monitor to perform as a repetition counter, it is necessary for the microprocessor 14 to detect the successive exercise repetitions being performed by the user. In the embodiment presently being described, this is accomplished by the use of the exercise motion detector 22. Upon each successive repetition, the exercise motion detector 22 outputs a signal to the microprocessor 14 to indicate the occurrence of an exercise repetition. The synthesis of each count by the speech synthesizer 18 is initiated only after the microprocessor detects a signal from the exercise motion detector 22. The microprocessor 14 may also be programmed using a known clock routine to monitor the time duration between successively performed repetitions, and, by comparing this duration with the repetition rate selected on repetition rate selector 12, determine whether the user is proceeding too slowly or quickly. In such cases, alarm indicia such as a beep or verbal warning may be issued. For example, if the exercise is being performed too slowly, the device could be programmed to synthesize the words "pick up the pace", "faster", and the like.

The microprocessor 14 also functions to produce a high level pulse on line 24 to boost the gain on an audio amplifier 26 to provide higher volume emphasis on selected words within the synthesized speech patterns produced by the speech synthesizer 18. The synthesized speech pattern is produced on output line 28 which is coupled to the audio amplifier 26. The audio amplifier 26 has a first amplification stage 30 which has an output coupled to a potentiometric volume control 32. A wiper 40 of the potentiometric volume control 32 is coupled to the input of a second amplification stage 42. The gain of the second amplification stage may be varied by the selective coupling of a feedback loop 46 to the input by the closure of a switch 48 upon the application of a high level signal on line 24 to a control terminal 50.

Certain enunciated repetition patterns may be comprised of a sequence of enunciated numbers which are individually separated by a selected motivational word or words such as "squeeze", "exhale", "concentrate", "almost done", "looking good", "toning up", and the like. Such motivational voice patterns may be enunciated at the frequency of the selected repetition rate. Rather than being inserted between enunciated count numbers in a sequential repetition count, these or other motivational voice patterns may be used to replace one or more count numbers, in which case the repetition numbers which are not verbally enunciated will have to be accounted for by the microprocessor 14 such that when the verbal count is again commenced, it begins with the correct number. Whether or not such a voice pattern may be inserted between enunciated count numbers in the sequential count or need to be added to replace one or more numbers depends on the length of the particular motivational word or phrase, the selected (and actual) repetition rate, and the enunciation pattern set by the user via the repetition rate selector 12 and enunciation pattern control switch 16. For example, while it may be possible to insert the word "exhale" between consecutively counted repetitions, it may not be possible to insert the phrase "no pain, no gain". As will readily be appreciated by those of ordinary skill in the art, since the time duration between successively enunciated repetitions decreases as the rate of the exercise increases, the microprocessor program will need to determine the amount of time needed for insertion of such motivational words.

The EEPROM of the microprocessor 14 includes a table of groups of addresses in which the number of groups are equal to the number of combinations of repetition rates, repetition numbers and enunciation patterns which may be selected. Each group of addresses comprises a number of addresses within the dictionary of the speech synthesizer 18 which are equal to the total number of enunciated words and sounds within a set of the selected combination of repetition rate, repetition number and enunciation pattern. One or more additional dummy addresses may be included to complete each table to indicate, for example, that the end of a set has been reached or that either no speech is to be generated for a given count value or that an audible sound other than human speech is to be generated. An example of a table of table of addresses stored in the microprocessor 14 EEPROM for a set having fifty repetitions in which each individual repetition is to be verbally counted is set forth below in Table I.

TABLE I

TABLE OF ADDRESSES FOR SET HAVING 50 REPETITIONS AND FULL ENUNCIATION

| Enunciated Speech | Relative Table Address |
|---|---|
| One | 1 |
| Two | 2 |
| Three | 3 |
| Ten | 10 |
| Eleven | 11 |
| Twelve | 12 |
| Thirteen | 13 |
| . | . |
| . | . |
| . | . |
| Twenty | 20 |
| Twenty One | 20, then 1 |
| Twenty Two | 20, then 2 |
| Twenty Three | 20, then 3 |
| . | . |
| . | . |
| . | . |
| Thirty | 21 |
| Thirty One | 21, then 1 |
| . | . |
| . | . |
| . | . |
| Forty | 22 |
| . | . |
| . | . |
| . | . |
| Fifty | 23 |

As noted above, it may also be desired to emphasize certain words or portions of words. For example, it is often desirable to emphasize the last one or last few count numbers in each set of repetitions. It may also be desired to emphasize some or all motivational words that may be inserted in the enunciation pattern. For this purpose, the microprocessor 14 may detect, on the basis of a program, count numbers or words which are to receive audio emphasis. The encoding of such words may be accomplished by the programming of a logical one in an unused bit position within the address bit positions which are available for communicating between the programmed microprocessor 14 and the speech synthesizer 18. The detection of a one in the unused bit position of an address in the table of addresses is used in the microprocessor program to signal when to produce one of the series of pulses on line 24 which boost the gain of the audio amplifier 26. The end of a set within each exercise routine is signalled by the detection of the count number which appears at the end of each set. In Table I, which shows addresses for a set of 50 repetitions, the 23rd address position performs this result. The enunciation of a word within a set of any selected combination of repetition rate, repetition number and enunciation pattern is initiated by the microprocessor control program by sequentially outputting the addresses of each word from the microprocessor 14 on the address bus 20 to the speech synthesizer 18 followed by the outputting of a pulse on line 22 which starts the actual synthesis of the word.

As described above, different address tables are used to access different stored sound data according to various combinations of repetition rate, repetition number and enunciation pattern. While the use of separately stored data accessed by different address tables dependent upon the repetition rate, repetition number and enunciation pattern is one method of achieving a variation in speech patterns, the invention is not so limited. Rather than using different address tables depending upon the repetition rate, the exercise monitor may be designed to count repetitions at a single time base, eliminating selected count values, if necessary, due to timing considerations. Instead, the device may be configured in order to speed up the enunciation of each word within a set by using a repetition rate selector having the potentiometric control and multivibrator as described above. In that case, the speed at which the speech is generated may be increased as the repetition rate is increased for a given combination of repetition number and enunciation pattern.

The simplest form of speech synthesis which is used with the exercise monitor of the present invention has a constant time base for enunciating each particular word independent of the repetition rate. This form of speech synthesis has the disadvantage that fast repetition rates do not sound natural because the duration of each enunciated word sounds too long for the repetition rate. When only one time base duration is used, the upper limit of the rate is reached when the successive words to be enunciated within a set do not have sufficient separation to prevent the words from running together. To produce a voice synthesis which sounds natural for widely varying repetition rates, the use of a multivibrator and potentiometric control for the repetition rate selector permits the use of different time bases for enunciating words which vary with the chosen repetition rate. Instead of one table of addresses for each set, such as that set forth in Table I above, two or more tables of addresses may be used, the first table being assigned to the enunciation of words at the slowest range of exercise rates, and each additional table being used to decrease the enunciation time of the words within the set. The number of tables to be used in the voice synthesis of each set of a given combination of a repetition number and enunciation pattern is purely a matter of choice. For example, when multiple address tables are used, it may be desirable for a given word within a set to be enunciated with half the time base for the highest range of exercise rates rather than the time base used to enunciate the same word at the slowest range of exercise rates.

Figure 2A:
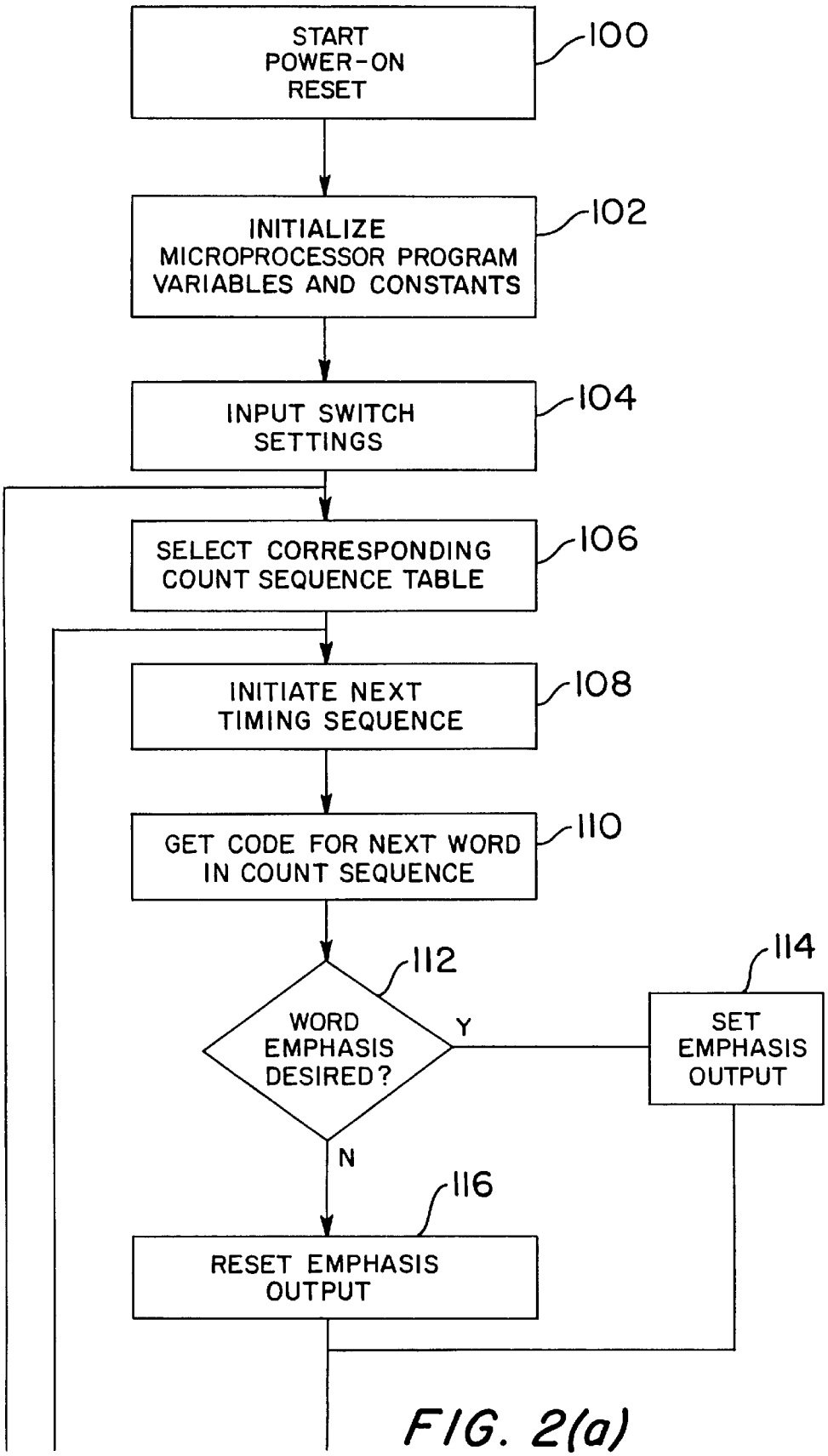
FIGS. 2(*a*) and 2(*b*) are a flowchart illustrating operations performed by the processor illustrated in the embodiment shown in FIG. 1.
Figure 2B:
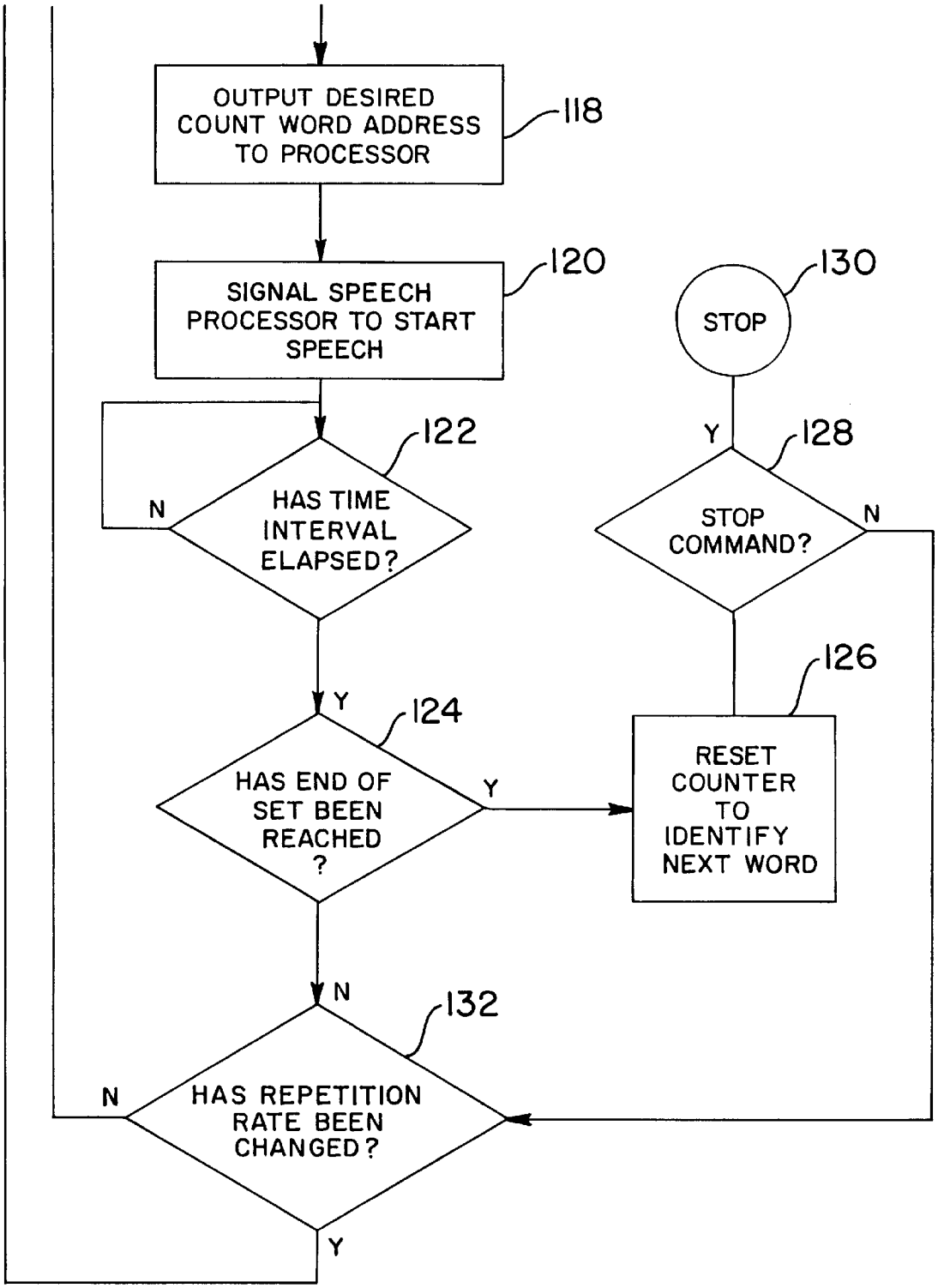

FIGS. 2(*a*) and 2(*b*) illustrate a flowchart of a computer program used by the microprocessor 14 for controlling the voice synthesis of any one of a plurality of combinations of repetition numbers and enunciation patterns at a selected exercise rate. The program starts at point 100 where the power is turned on and all circuits are reset. The program next proceeds to step 102 where the microprocessor, input/output lines, program variables and constants are initialized. The program next proceeds to step 104 where the selected combination of repetition number and enunciation pattern is read from the repetition number control switch 15 and enunciation pattern control switch 16 which have been positioned by the user. The preferred choices of repetition number and enunciation pattern have been described above, but it should be clearly understood that the invention is applicable to producing any desired group of repetition number and enunciation patterns at any selected exercise rate. The program next proceeds to step 106 where the selected combination of repetition number and enunciation pattern is used to identify the group of addresses within the EEPROM of the microprocessor 14 which are to be used to synthesize the voice pattern of an exercise set in accordance with the selected combination of the repetition number and enunciation pattern.

The table of addresses discussed above would be used in the case where 50 repetitions per set is selected and a verbal count for each repetition is to be enunciated. It should be clearly understood that a group of addresses for each combination of repetition number and enunciation pattern is read from the EEPROM of the microprocessor 14 for synthesizing that particular combination of repetition number and enunciation pattern. Moreover, when the time base is dependent upon the exercise rate, each selected combination of repetition number and enunciation pattern will have as many tables associated with it as there are time bases.

The program next proceeds to step 108 where the monostable multivibrator within the exercise rate selector 12 is triggered and the time interval during which the monostable multivibrator is in its high state is begun. When a repetition signal is detected due to closure of the mechanical switch 22, the program then proceeds to step 110 where the number of the word within a set which is next to be synthesized is obtained by reading the count of an internal counter within the microprocessor 14. In the case of each combination of exercise rate, repetition number and enunciation pattern, the first word is assigned the count of one and each successive word within a set is assigned a successive number until the set is completed. The count functions as the mechanism for choosing the address within the group of addresses used for synthesizing the next word within a set of the selected combination of repetition rate, repetition number and enunciation pattern to be synthesized by the voice synthesizer 18. The program next proceeds to decision point 112 where a determination is made if the audio gain of the audio amplifier 26 is to be increased for the enunciation of that word by closing the switch 48. As described above, the determination is made by checking an unused address bit to determine if it has been set high. If the next word to be synthesized is not to be emphasized, the program proceeds to block 116 where the switch 48 is reset to insure that the audio gain of the audio amplifier 26 will not emphasize the next word. The program then proceeds to step 118 where the address of the next word to be voice synthesized, which has been obtained from the address table, is output on the bus 20 of the microprocessor 14 to the voice synthesizer 18. The program then proceeds to step 120 where an output signal is placed on line 20 of the microprocessor for the purpose of instructing the speech synthesizer 18 to start the voice synthesis of the desired word.

Subsequently, the program proceeds to decision point 122 where the program loops until one word at the chosen rate is completed. The completion of one word is signalled by the repetition rate selector 12 changing from its high state to a low state. As described above, the duration of the high state of the monostable multivibrator within the repetition rate selector 12 is a function of the RC time constant which is determined by the adjustment of the repetition rate selector 12. The program next proceeds to decision point 124 where a determination is made as to whether the end of a set has been reached. In the case of the repetition number illustrated in Table I above, the 23rd address position within the table signals that the end of a set has been reached. If the answer is yes, the program proceeds to step 126 where the internal counter, which is read at step 110 to obtain the address of the next word to be voice synthesized within the group of addresses for the selected combination of repetition rate, repetition number and enunciation pattern is set to 1 to prepare the voice synthesizer 18 to repeat the enunciation of the set. The program proceeds to decision point 128 where a determination is made as to whether a stop command has been issued.

A stop command may be signalled by turning off the power or the pushing of a stop command control (not shown) which may be provided on the front panel of the housing which contains the exercise monitor. If a stop command has been generated, the program enters a stop phase at step 130. If the answer is no, the program proceeds to decision point 132 where a determination is made as to whether the same repetition rate, repetition number and enunciation pattern is still being specified by the repetition rate selector 12, repetition number control switch 15 and enunciation pattern control switch 16. If there is no change in the repetition rate, repetition number and enunciation pattern, the program loops back to step 108 where a new time interval is begun by the exercise rate selection control 112. If there has been a change in the repetition number and enunciation control 16, the program loops to step 106 to obtain the table of a newly selected repetition rate, repetition number and enunciation pattern. If the end of a set has not been detected at decision point 124, the program proceeds to decision point 132 which functions in the manner described above. The program will continue to produce synthesized speech at the selected exercise rate until manually stopped by turning off the power or pushing a stop button. Any adjustment in the selected exercise rate is immediately picked up at block 108 where the time interval is changed by the adjustment of the repetition rate selector 12.

It should be clearly understood that the combination of repetition rate, repetition number and enunciation pattern which have been specifically set forth above are only representative of the potential combinations of repetition rates, repetition numbers and enunciation patterns which may be voice synthesized by the invention. Countless other values and combinations may be used. The invention may also be used for maintaining a desired exercise rate in exercise classes.

The invention has been described in terms of its preferred embodiment. However, it should be clearly understood that numerous modifications may be made thereto without departing from the scope of the invention as defined by the appended claims.

Figure 3:
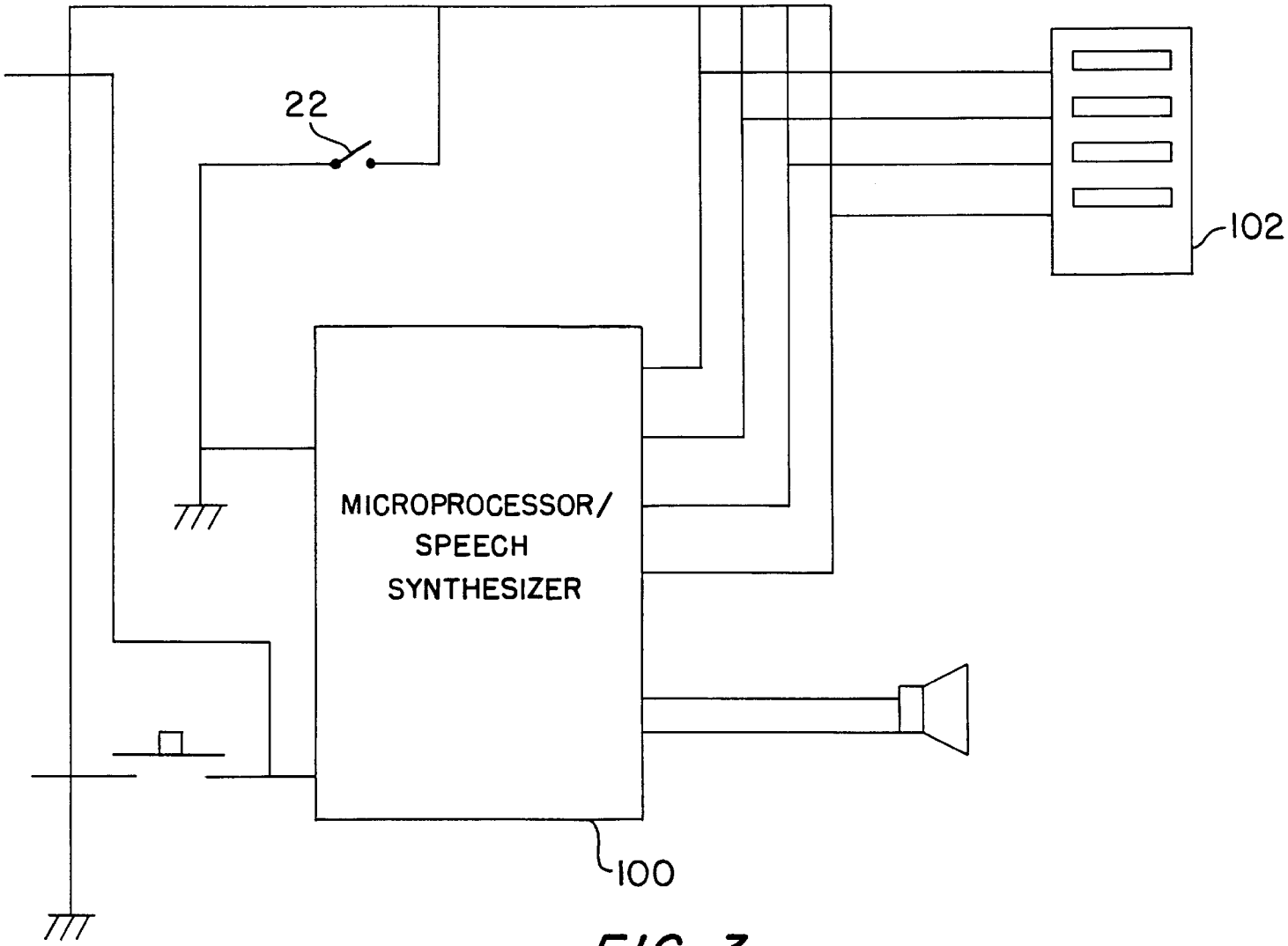
FIG. 3 is a schematic diagram of an exercise monitoring apparatus in accordance with a second embodiment of the present invention.

FIG. 3 illustrates a second embodiment of the electronic exercise monitor of the present invention. In this embodiment, the microprocessor and speech synthesizer, which are shown separately in FIG. 1, are combined in a single chip 100. While the device is provided with a repetition number control DIP switch 102, no selectors are provided for the setting of a repetition rate or enunciation pattern. These values are instead determined by a microprocessor control program stored in the single chip microprocessor controlled speech synthesizer 100. In addition, amplification of the synthesized speech or audible indicia is performed internally, and is also set by the microprocessor program in a known manner.

As noted above, the exercise monitor of the present invention may be used as a stand-alone device for monitoring any type of repetitive exercise activity, or may be incorporated into a piece of exercise equipment of the type having a displaceable member adapted to undergo reciprocal or repetitive movement during an exercise routine. In the former case, for instance, the mechanical switch 22 (exercise motion detector) must be placed in a position in which closure of the switch will occur once for each repetition. For example, when the exercise is situps, the switch may be of appropriate design such that when placed on the floor or on an exercise mat (or mounted within the mat), the switch contacts become temporarily closed once for each situp. The mechanical switch 22 may also be disposed on or in an exercise device such that the contacts become temporarily closed in a similar manner. For instance, if the mechanical switch 22 is disposed in a free weight or bar, the switch must be of an appropriate design so as to undergo temporary closure once each repetition.

Figure 4A:
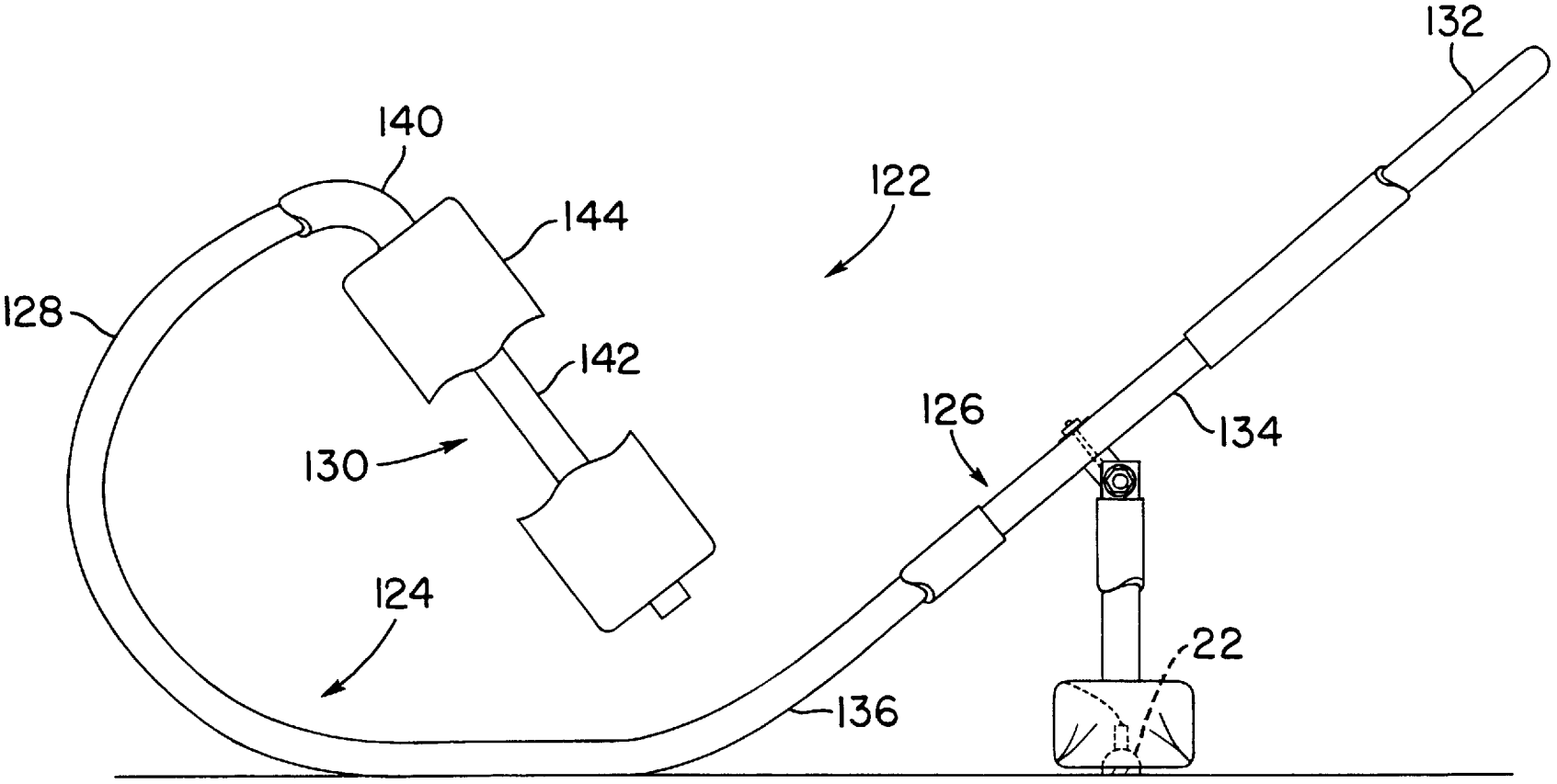
FIG. 4 is a diagram of an abdominal exercise device to which the exercise monitoring apparatus of the present invention is mounted.
Figure 4B:
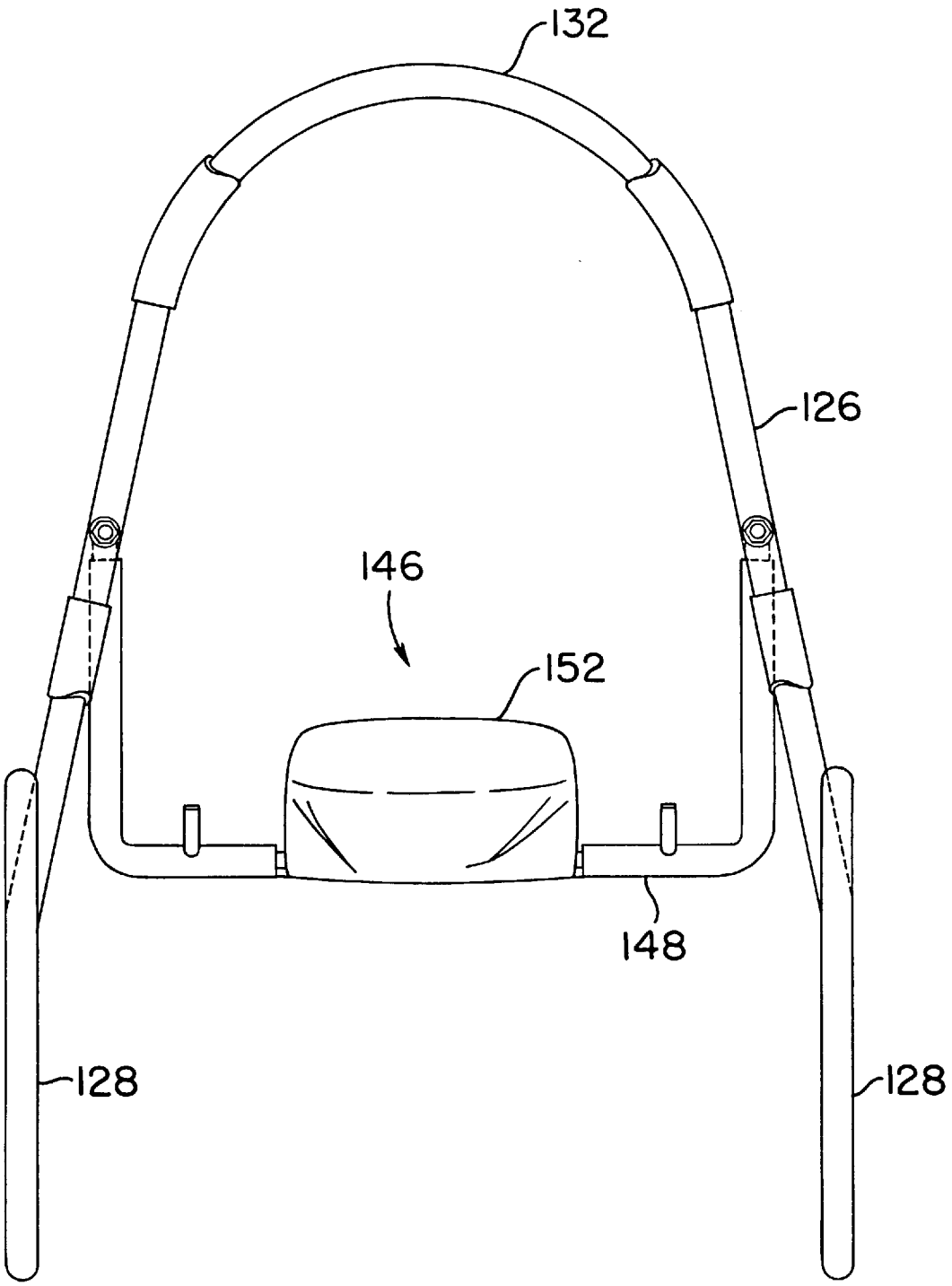

For instance, FIGS. 4*a* and 4*b* illustrate the exercise monitor 120 of the present invention as mounted to an abdominal exerciser 122. The abdominal exerciser 122 is formed of a skeletal frame 124, for example, from a single hollow tube of aluminum or other rigid material. The skeletal frame 124 includes a pair of support rails 126, a pair of arcuate rocker portions 128, each of which extends forwardly from a respective support rail 126, a pair of arm rest portions 130, each of which extends from a respective rocker portion 128, and an arch-shaped portion 132 which is connected to and between the support rails 126.

The support rails 126 are laterally spaced from each other to rest on a support surface, such as a floor. Each support rail 126 extends between a rocker portion 128 and the arch-shaped portion 132 and, as illustrated, each support rail 126 includes a straight portion 134 which extends from a rocker portion 128, and an arcuate portion 136 extending from the straight portion 134.

The two rocker portions 128 are parallel to each other but may also be directed inwardly towards each other at a small angle to accommodate the elbows of the person using the abdominal exerciser device 122. Each arm rest portion 130 extends from a rocker portion 128 and is bent over to form an L-shape. As illustrated, each arm rest portion 130 has a curved portion 140 extending from a rocker portion 128 and a straight free end portion 142. The curved portion 140 forms a right angle bend. In addition, the free end portion 142 has a removable cushion 144 mounted thereon to receive an elbow or arm of the person disposed between the support rails 126.

As shown, a support means 146 is secured to and across the arch-shaped portion 132 for supporting the neck and head of a person disposed between the support rails 126. The support means 146 includes a rigid U-shaped bar 148, for example, of aluminum which is pivotally mounted by suitable means 150 on the straight portions of the arch-shaped portion. In addition, the support means 146 includes a padded head rest 152 which is secured to a horizontal part of the U-shaped bar. The U-shaped bar 148 is freely pivotable relative to the arch-shaped portion so as to be moved from a position as shown in the drawings in which the bar is vertical and rests on a floor or on other support surface.

When the exercise device 122 is in a position of rest, the user may perform an exercise which involves resting one's head on the head rest while grasping the arch-shaped portion and resting one's arms and elbows on the arm rest cushions. At this time, the user may raise his/her legs into a vertical position. The legs may then be lowered while being maintained in a parallel relation.

In order to conduct an exercise program for exercising the abdominal muscles, the following steps are followed:

First, the user positions himself or herself in a supine position within the skeletal frame of the exercise device while placing his or her neck and head on the head rest of the support means.

Next, the user rests his or her elbows on the arm rest portions, that is, on the cushions slidably mounted on the arm rest portions. The user is now ready to begin a curling exercise. At this time, with the user's hands gripping the upstanding arch-shaped portion, the user begins to curl his or her spine forwardly while rocking the frame forwardly on the rocker portions. After reaching a partially flexed or fully flexed position, the user returns to the supine position while rocking the skeletal frame rearwardly on the rocker portions. The curling and uncurling steps are repeated until the exercise program has been completed.

The mechanical switch 22 of the exercise monitor 120 comes into contact with the floor each time the user completes a single repetition. The switch 22 provides a pulse output signal each time a repetition is performed. The pulse is provided as an input to the microprocessor 14 shown in FIG. 1, or as an input to the combined microprocessor/speech synthesizer device 100 illustrated in FIG. 3. Accordingly, when exercise is performed using the abdominal exerciser, the exercise monitor 120 generates a human voice to count the repetitions being performed by the user in accordance with the repetition rate, repetition number and enunciation pattern set by the user. Motivational words are preferably interlaced within the verbal count by the microprocessor program to provide the user with encouragement and motivation which has not heretofore been available.

In a like manner, the exercise monitor may be incorporated into many different types of exercise equipment, such as a barbell, dumbbell, rowing machine, or universal-type equipment such as a chest press machine, a rigid arm lat pull-down machine, a shoulder press machine, a pectoral fly machine, a seated hamstring machine, a leg extension machine, an inner/outer thigh combo machine, or an abdominal crunch machine. As will be appreciated by those of ordinary skill in the art, depending upon the exercise for which the monitor is used or the type of equipment in which it is incorporated, the motivational speech patterns will be different, in each case being relevant to the exercise being performed.

Figure 5:
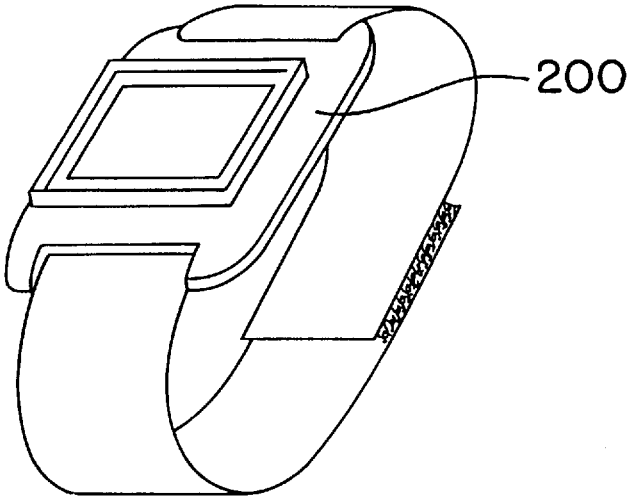
FIG. 5 is a view of an embodiment of the present invention in which the exercise monitor is provided in a watch case worn on a user's wrist.

FIG. 5 is an illustration of the exercise monitor of the present invention as incorporated into a watch case 200. As noted above, the exercise motion detector need not be a mechanical switch, but can be a device capable of detecting repetitious motion in a given direction, such as an accelerometer. Thus, by providing the exercise monitor in a watch case, the device is capable of detecting exercises that involve arm movement, such as walking or running, situps, and the like. Similarly, the device can be provided in a case capable of being worn on a user's waist, neck, ankle, and the like.

Additionally, the device may be programmed to issue not only motivational speech patterns, but also promotional speech patterns to promote one or more commercial products of a given producer or supplier. In that case, such speech patterns are preferably generated as the individual commences or completes a particular set of exercises.

The invention has been described in terms of various preferred embodiments and variations thereof. However, it should be clearly understood that numerous modifications may be made thereto without departing from the scope of the invention as defined by the appended claims.

I claim:

1. An exercise monitor for monitoring the performance of an exercise by a user, comprising: an exercise motion detector for detecting a repetitive motion associated with the performance of repetitive exercise movements and outputting a corresponding signal; processing means for receiving the signal and determining therefor a starting address at which a block of corresponding sound data is stored; a memory for storing sound data for a selected plurality of sequential exercise repetitions, the sound data including first sound data representing a voice count number for selected repetitions of the exercise and second sound data representative of a plurality of verbal phrases for encouraging the user to continue to perform the exercise; and a speech generator for generating a voice in accordance with the sound data stored in the memory, the speech generator being controlled by the processing means in response to the signal output by the exercise motion detector to progressively count selected exercise repetitions performed by the user and to generate a selected verbal phrase based on the count value of an exercise being performed by the user so as to motivate the user to continue to perform the exercise or to provide a verbal alarm to the user.

2. An exercise monitor according to claim 1; wherein the second sound data further comprises data representative of a verbal alarm; and the processing means includes means for controlling the speech generator to generate a verbal alarm based on the count value of an exercise being performed by the user.

3. An exercise monitor according to claim 1; wherein the memory stores voice count numbers determined based upon the number of exercise repetitions performed by the user.

4. An exercise monitor according to claim 1; further comprising a case for housing the exercise monitor, the case being wearable by the user.

5. An exercise monitor according to claim 1; wherein the exercise motion detector comprises an accelerometer for detecting movement of the user.

6. An exercise monitor according to claim 1; wherein the processing means includes means for controlling the speech generator to generate a voice count only for selected ones but not all of the total exercise repetitions.

7. An exercise monitor according to claim 1; further comprising display means for providing a visual display indicative of performance of the exercise by the user.

8. An exercise monitor according to claim 1; further comprising a selector for selecting an enunciation pattern of the speech generator such that the voice count is generated at appropriate time intervals associated with the number of exercise repetitions performed by the user.

9. An exercise monitor according to claim 1; further comprising a selector connected to the processing means for selecting a desired number of repetitions per set such that generation of a voice count number is reset each time the user completes a set of an exercise.

10. An exercise monitor according to claim 1; wherein the processing means includes means for controlling the speech generator to generate the selected verbal phrase between or in place of one or more successive verbal count numbers depending upon the length of the selected verbal phrase, the repetition rate and an enunciation pattern of the speech generator.

11. An exercise monitor for monitoring the performance of an exercise by a user, comprising: detecting means mountable to a displaceable member of an exercise device, the detecting means being responsive to cyclical motion of the displaceable member to output a signal which varies in accordance with the cyclical motion; processing means for receiving the signal and determining, based upon the variations thereof, a starting address at which a block of corresponding sound data is stored; a memory for storing sound data for a selected plurality of sequential cycles of movement of the displaceable member, the sound data including first sound data representative of a voice count number for selected cycles of said movement and second sound data representative of a plurality of verbal phrases for encouraging the user to continue to perform the exercise; and a speech generator for generating a voice in accordance with the sound data stored in the memory, the speech generator being controlled by the processing means in response to the detecting means to progressively count a variable determined based on the number of cycles of movement of the displaceable member, and to generate a selected verbal phrase based on the value of the counted variable of the exercise being performed by a user so as to inform the user of his or her progress, to motivate the user to continue to perform the exercise, or to provide a verbal alarm to the user.

12. An exercise monitor for monitoring the performance of an exercise by a user, comprising: an exercise detector for monitoring a function associated with the performance of an exercise and outputting a corresponding signal which varies in accordance with the monitored exercise function; processing means for receiving the signal and determining therefor a starting address at which a block of corresponding sound data is stored; a memory for storing first sound data associated with the monitored exercise function and second sound data representative of a plurality of verbal phrases for encouraging the user to continue to perform the exercise; a speech generator for generating a voice in accordance with the sound data stored in the memory, the speech generator being controlled by the processing means in response to the exercise detector to output a verbal representation of a variable determined in accordance with the monitored exercise function at selected times as a user progressively performs the exercise, and to output a selected verbal phrase selected from the second sound data based on the value of the variable so as to inform the user of his or her exercise progress, to motivate the user to continue to perform the exercise correctly, or to provide a verbal alarm to the user.

* * * * *